US007900680B2

(12) United States Patent
Garmyn et al.

(10) Patent No.: US 7,900,680 B2
(45) Date of Patent: Mar. 8, 2011

(54) HEAD RAIL ASSEMBLY

(75) Inventors: Tomas M. A. H. Garmyn, Willebroek (BE); Jorg Bohlen, Langen (DE); Lars Koop, Bremerhaven (DE)

(73) Assignee: Hunter Douglas Industries B.V., El Rotterdam (NL)

( * ) Notice: Subject to any disclaimer, the term of this patent is extended or adjusted under 35 U.S.C. 154(b) by 245 days.

(21) Appl. No.: 12/200,053

(22) Filed: Aug. 28, 2008

(65) Prior Publication Data

US 2009/0056885 A1 Mar. 5, 2009

(30) Foreign Application Priority Data

Aug. 31, 2007 (EP) ..... 07017083

(51) Int. Cl.
*E06B 9/17* (2006.01)

(52) U.S. Cl. ..... 160/23.1; 160/321

(58) Field of Classification Search ..... 160/23.1, 160/24, 321, 38, 319, 193
See application file for complete search history.

(56) References Cited

U.S. PATENT DOCUMENTS

| | | | | | |
|---|---|---|---|---|---|
| 2,099,068 | A | * | 11/1937 | Keithly | 160/23.1 |
| 3,854,517 | A | * | 12/1974 | Nakamura | 160/323.1 |
| 4,424,852 | A | * | 1/1984 | Hopper | 160/309 |
| 4,492,261 | A | * | 1/1985 | Chong | 160/319 |
| 4,757,852 | A | * | 7/1988 | Jentof et al. | 160/23.1 |
| 5,092,389 | A | | 3/1992 | Tedeschi | |
| 6,116,325 | A | * | 9/2000 | Colson et al. | 160/321 |
| 6,148,894 | A | * | 11/2000 | Judkins | 160/177 R |
| 6,935,401 | B2 | * | 8/2005 | Fraczek et al. | 160/321 |
| 2006/0289120 | A1 | * | 12/2006 | Pielmeier | 160/23.1 |
| 2009/0056885 | A1 | * | 3/2009 | Garmyn et al. | 160/323.1 |

* cited by examiner

*Primary Examiner* — Blair M. Johnson
(74) *Attorney, Agent, or Firm* — Dorsey & Whitney LLP

(57) ABSTRACT

A head rail or head rail assembly for an architectural closure, the head rail including an elongate front wall having left hand and right hand longitudinal ends and an elongate bottom wall having left hand and right hand longitudinal ends. A left hand end structure is positioned adjacent to the left hand longitudinal end of the bottom wall and a right hand end structure is positioned adjacent to the right hand longitudinal end of the bottom wall. A first slot is defined between the left hand end structure and the left hand longitudinal end of the bottom wall and a second slot is defined between the right hand end structure and the right hand longitudinal end of the bottom wall. At least one of the first and second slots is closed by a removable closure.

14 Claims, 9 Drawing Sheets

HEAD RAIL ASSEMBLY

CROSS REFERENCE TO RELATED APPLICATION

This application claims priority to European Patent Application No. 07017083.2 filed on 31 Aug. 2007, and such application is hereby incorporated by reference as if fully disclosed herein.

BACKGROUND OF THE INVENTION

1. Field of the Invention

The invention relates to a head rail for an architectural covering, such as a roller blind or screen.

2. Description of the Relevant Art

Head rails are fairly common as upper structures of retractable window coverings, such as Venetian type blinds and roll-up curtains or blinds. In known examples, such as those disclosed in U.S. Pat. No. 6,148,894 and U.S. Pat. No. 5,092,389, provisions have been made to enable the user or the installer to select between controlling the blind from one or the other end of the head rail. In the known head rail assemblies the operating controls will alternatively exit from either a front wall or a rear wall of the head rail. Repositioning the controls from the left hand side of an architectural opening to the right hand side, or vice versa, thereby requires the entire blind to be reversed front to rear. With such head rails it is thus strictly necessary that the front and rear walls should be equally suitable to be exposed to the front and fulfill certain decorative requirements. There can however be reasons not to shape the front and rear walls of a head rail identically or to have a blind that is reversible by having identical front and rear surfaces.

BRIEF SUMMARY OF THE INVENTION

Accordingly it is an object of the present invention to provide a head rail assembly that enables the user or the installer to select between control ends without being limited to a reversible shape of the head rail or the blind. A further object of the invention is to overcome or ameliorate at least one of the disadvantages of the prior art. It is also an object of the present invention to provide alternative structures which are less cumbersome in assembly and operation and which moreover can be made relatively inexpensively. Alternatively it is an object of the invention to at least provide the public with a useful choice.

To this end, the invention provides a head rail for an architectural covering, the head rail including: an elongate front wall having left hand and right hand longitudinal ends, an elongate bottom wall having left hand and right hand longitudinal ends, a left hand end structure positioned adjacent to the left hand longitudinal end of the bottom wall; and a right hand end structure positioned adjacent to the right hand longitudinal end of the bottom wall, wherein a first slot is defined between the left hand end structure and the left hand longitudinal end of the bottom wall, wherein a second slot is defined between the right hand end structure and the right hand longitudinal end of the bottom wall, and wherein at least one of the first and second slots is closed by a removable closure. In this way the head rail has an exit for a control device on either of its longitudinal ends. It is thus not necessary to turn the head rail end for end when the control device is desired at an opposite side of the architectural covering. It is also no longer necessary to have identical front and rear walls on the head rail and the rear structure of the head rail can thereby be shaped to serve a functional purpose rather than a mere decorative purpose. Also the blind material suspended from the head rail can now be given distinct opposite surfaces in accordance with specific functional properties required at the interior side and at the exterior side of architectural openings.

Other advantageous embodiments will be apparent from the appended claims and the following description.

BRIEF DESCRIPTION OF THE DRAWINGS

The invention will now be described in reference to one possible embodiment as illustrated in the accompanying drawings, in which.

DESCRIPTION OF THE PREFERRED EMBODIMENTS

Figure 1:
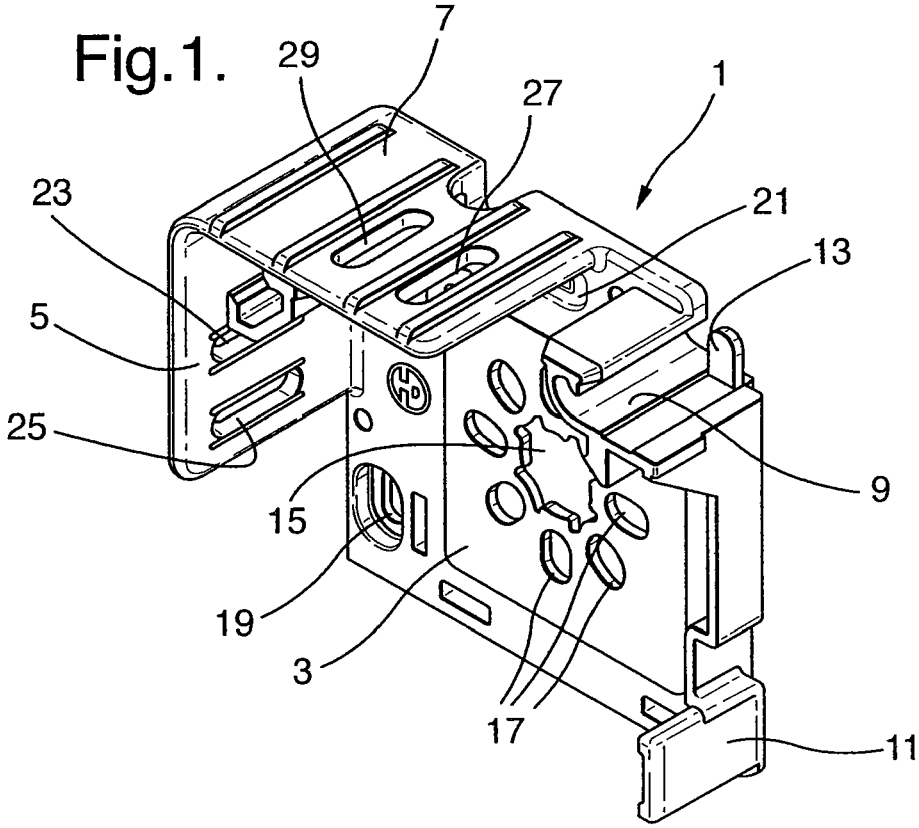
FIG. 1 shows in perspective, an interior side of a right hand end structure.

FIG. 1 shows a right hand end structure 1 that has a web portion 3, a rear mounting flange 5 and a top mounting flange 7. Also extending from the web portion 3 are a first wall engagement formation 9 and a second wall engagement formation 11. Associated with the first engagement formation 9 is an abutment 13 for a purpose to be described herein below. Web portion 3 is also provided with a central aperture 15 for receiving either an end bearing of a roller blind roller or a control device for a driving end of such a blind roller.

Figure 2:
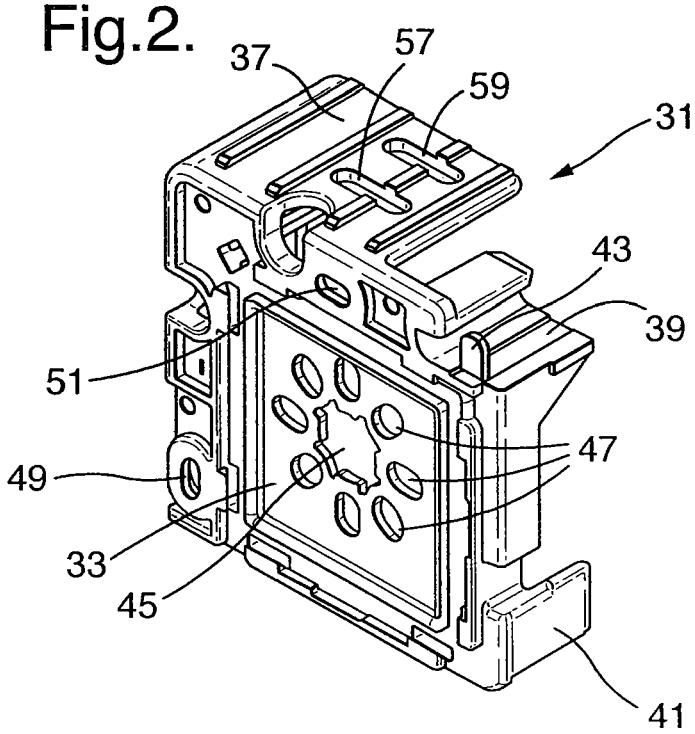
FIG. 2 shows, in perspective, an exterior side of a left hand end structure.

The central aperture 15 in the illustrated embodiment is surrounded with an optional array of angular positioning openings 17. The angular positioning openings 17 can be used to locate a control device in different angular positions in respect of the central aperture 15. The right hand end structure 1 further has first and second mounting holes 19, 21 in its web portion 3, offering the option of mounting the end structure to a wall surface that co-extends with the web portion 3. Mostly however the right hand end structure 1 will be mounted to rear surface using in the rear mounting flange 5, or to an overhead surface using the top mounting flange 7. To this end the rear mounting flange 5 is provided with first and second slotted openings 23, 25 and the top mounting flange 7 is provided with third and fourth slotted openings 27, 29. FIG. 2 shows a left hand end structure 31 which is substantially a mirror image of the right hand end structure 1 of FIG. 1. Similar parts of the left hand end structure 31 in FIG. 3 will be referred to by reference numerals that are a full thirty higher than those used in FIG. 1. The left hand end structure 31 has a web portion 33 and a top mounting flange 37. Similar to the right hand end bracket there is also a rear mounting flange, but which is hidden from view in the exterior perspective orientation of FIG. 2. Again extending from the web portion 33 are a first wall engagement formation 39 and a second wall engagement formation 41. The first wall engagement formation 39 has an abutment 43. A central aperture 45 is provided in the web portion 33 which is surrounded by optional angular positioning openings 47 for positioning a drive unit. The web portion 33 further has first and second mounting holes 49, 51 and the top mounting flange 37 has first and second mounting slots 57, 59.

Figure 3:
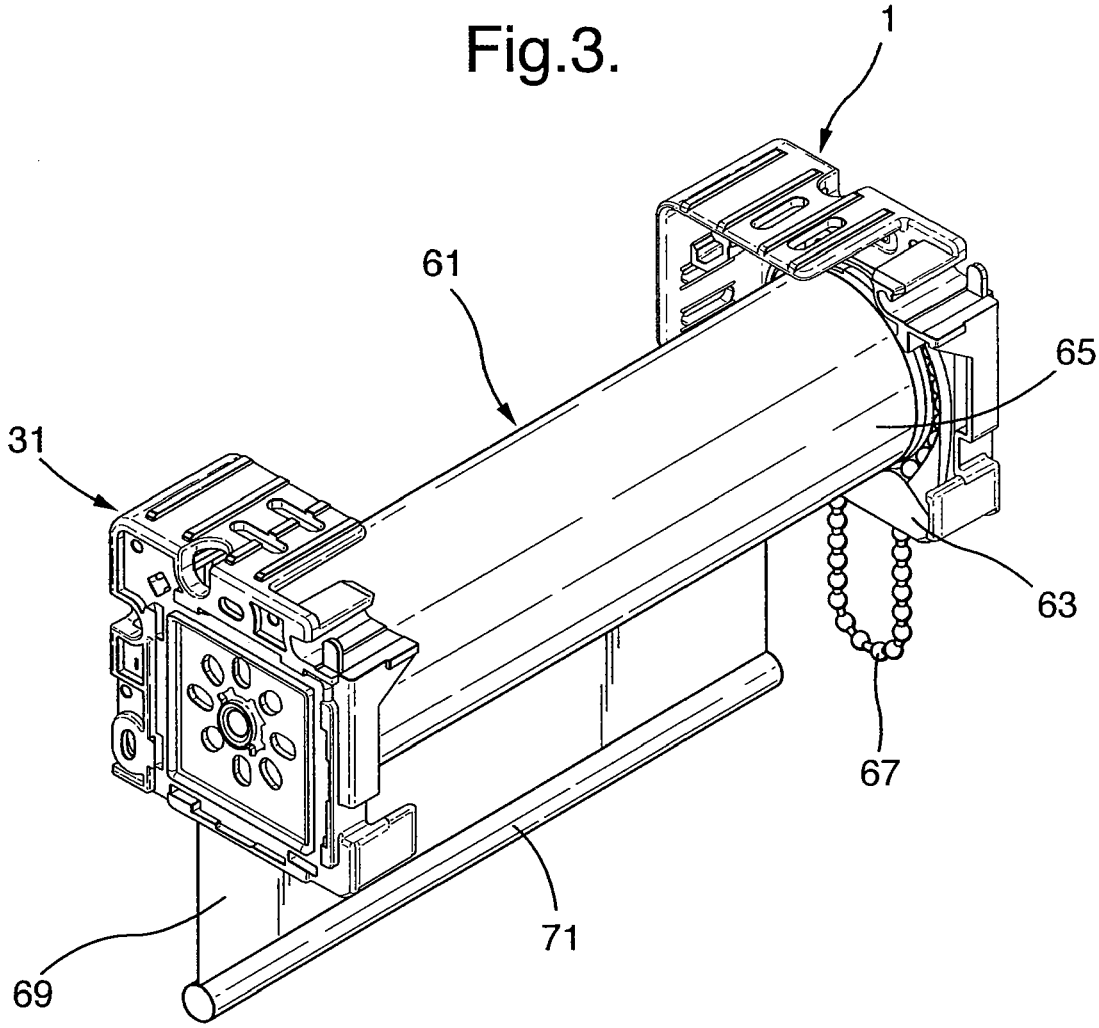
FIG. 3 is a perspective view of a partly assembled roller blind with a blind roller carried between opposite right and left hand end structures.
Figure 4:
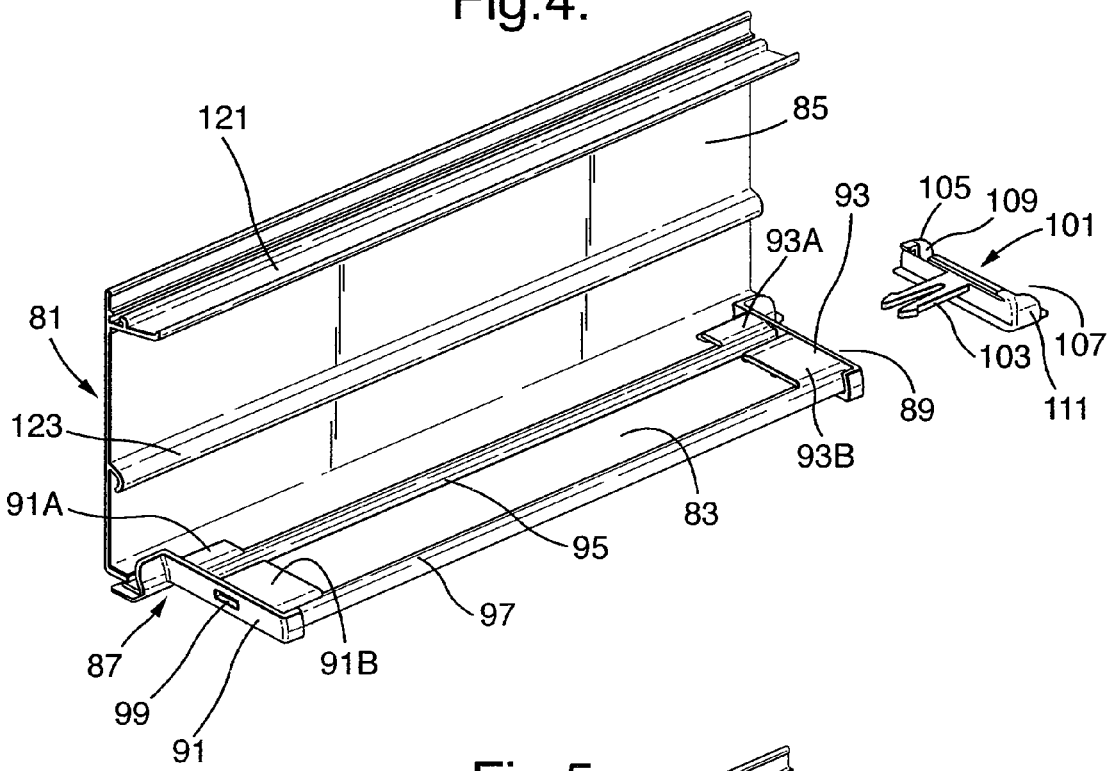
FIG. 4 shows one possible form of a bottom wall of the roller blind of FIG. 3 and a removable closure in a perspective explosion view prior to mounting.
Figure 5:
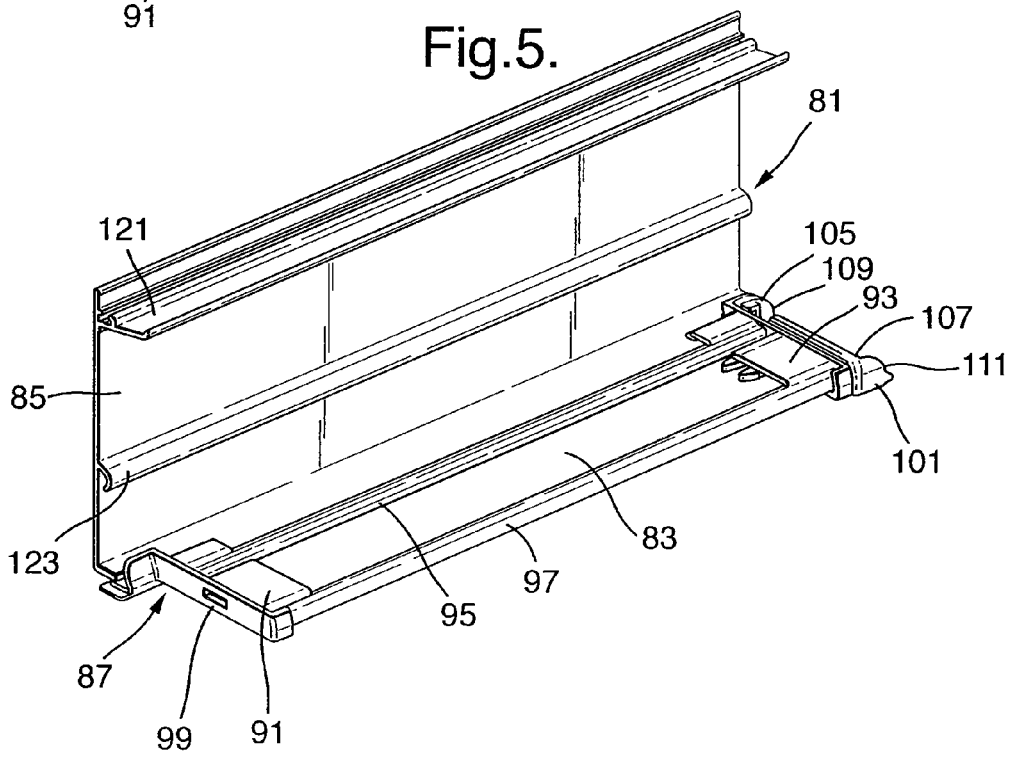
FIG. 5 shows the bottom wall of FIG. 4 in assembled condition.
Figure 6:
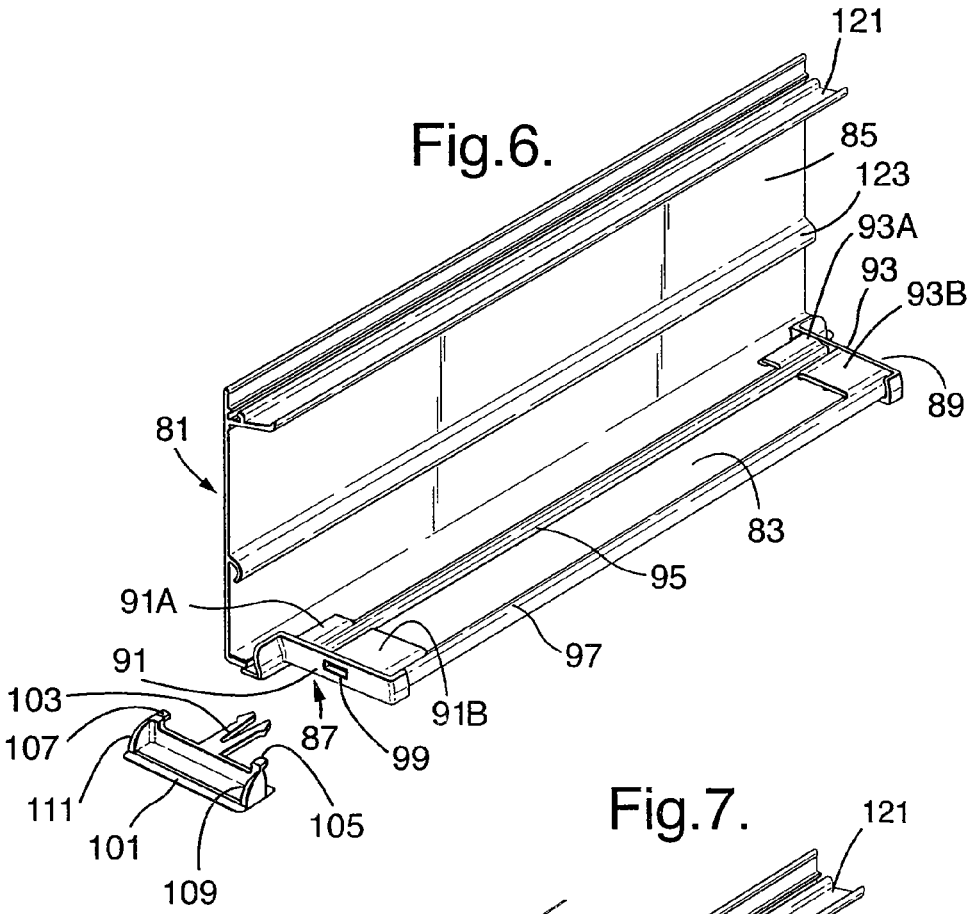
FIG. 6 is a view similar to FIG. 4, but with the removable closure positioned for mounting to another end of the bottom wall.
Figure 7:
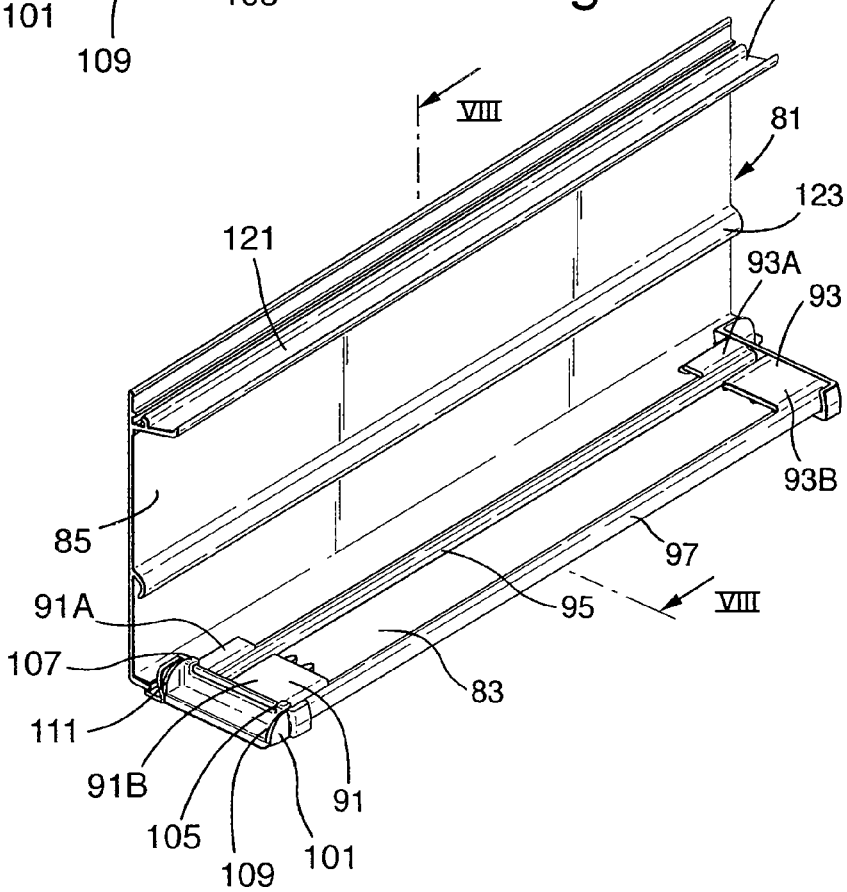
FIG. 7 is a view similar to FIG. 5 but with the removable closure assembled to the other end of the bottom wall.

FIG. 3 shows a part assembly of the right hand end structure 1, the left hand end structure 31 and a roller blind 61. The roller blind 61 has a control device 63 on one longitudinal end of a blind roller 65. The control device 63 can be operated by a ball chain 67. Windable on and from the roller 65, by operating the ball chain 67, is a blind fabric or screen 69 which is kept taught by a weighted bottom bar 71.

FIGS. 4 to 7 show the respective preparatory stages of a wall element 81 for a head rail of the invention. The wall element 81 is provided with a bottom wall 83 and an integral front wall 85. The bottom wall 83 has a right hand cut-out 87 and a left hand cut-out 89. The right hand cut-out 87 is furnished with a right hand edge cover 91 and the left hand cut-out 89 is furnished with a corresponding left hand edge cover 93. The right hand and left hand edge covers 91, 93 each have protrusions 91A, 91B, 93A, 93B, which cooperate with first and second holding groove formations 95, 97 on an inside of the bottom wall 83. Each of the right hand and left hand edge covers 91, 93 is also provided with a rectangular slot 99 which opens into a funnel defined by the relevant protrusion 91B, 93B and the inside surface of the bottom wall 83. The rectangular slot 99 cooperates with a bifurcated flexible insertion tongue 103 of a removable closure 101. The closure 101 also has first and second retaining hooks 105, 107 and first and second curved guiding surfaces 109, 111.

Figure 8:
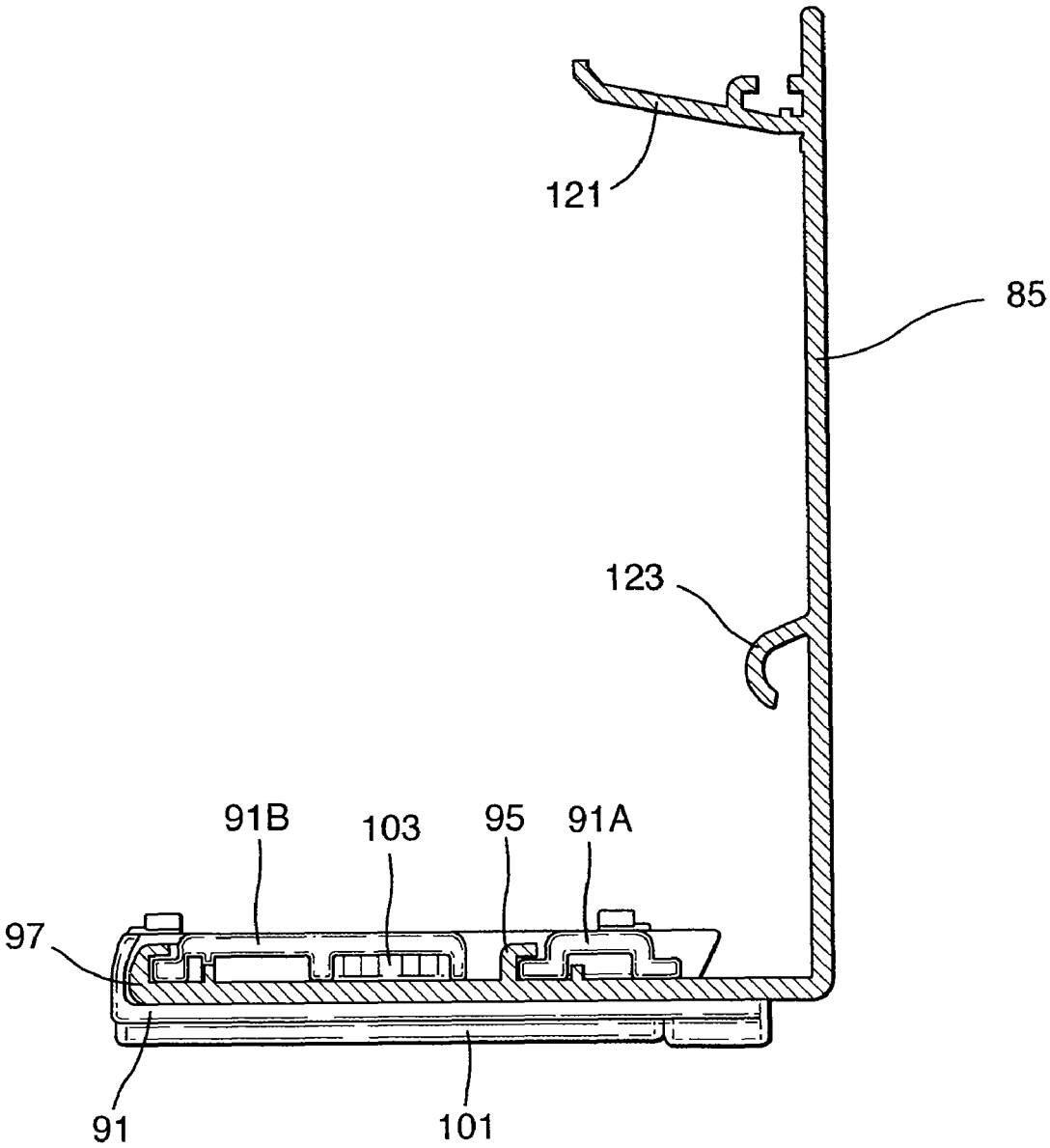
FIG. 8 is a transverse cross-sectional view of the bottom wall of FIG. 7 over the line VIII-VIII in FIG. 7.

The front wall 85 as more clearly visible in FIG. 8, has a first engagement ridge 121 and a second engagement ridge 123. The first engagement ridge 121 is designed to pivotally hook into the first wall engagement formations 9, 39 of the right hand and left hand end structures 1, 31 respectively. The second engagement ridge 123 is designed to snap fittingly engage behind the second wall engagement formations 11, 41 of respectively the right hand and left hand end structure 1, 31.

Figure 9:
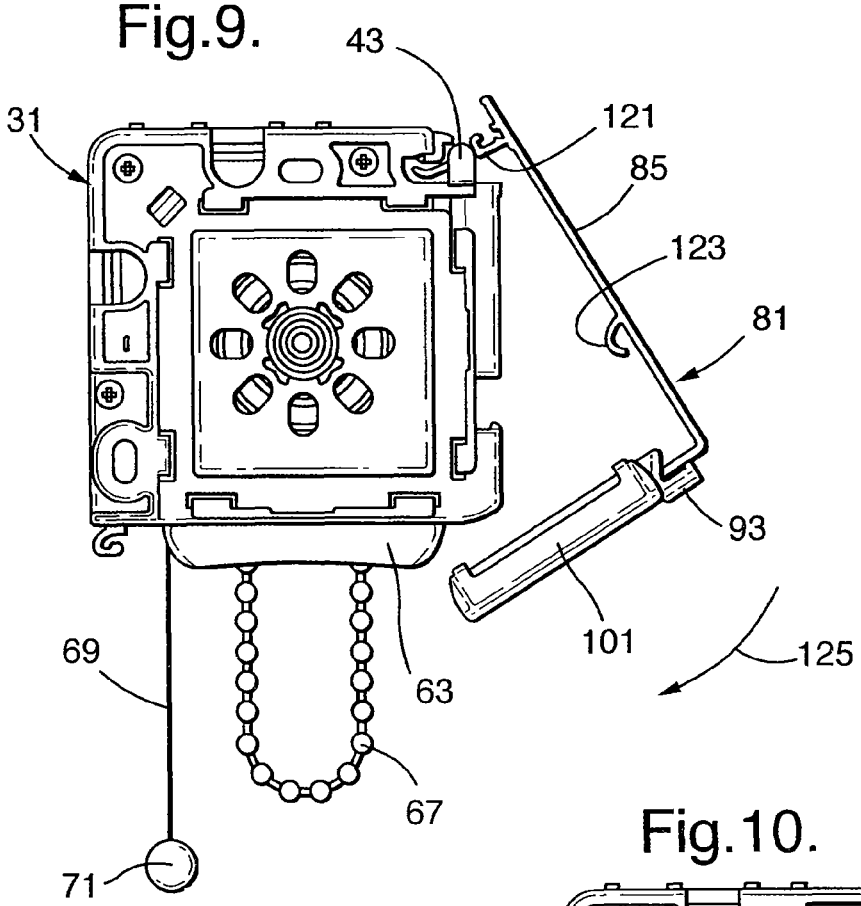
FIG. 9 shows in elevation the bottom wall of FIG. 5 in position for being mounted onto the partly assembled roller blind of FIG. 3.
Figure 10:
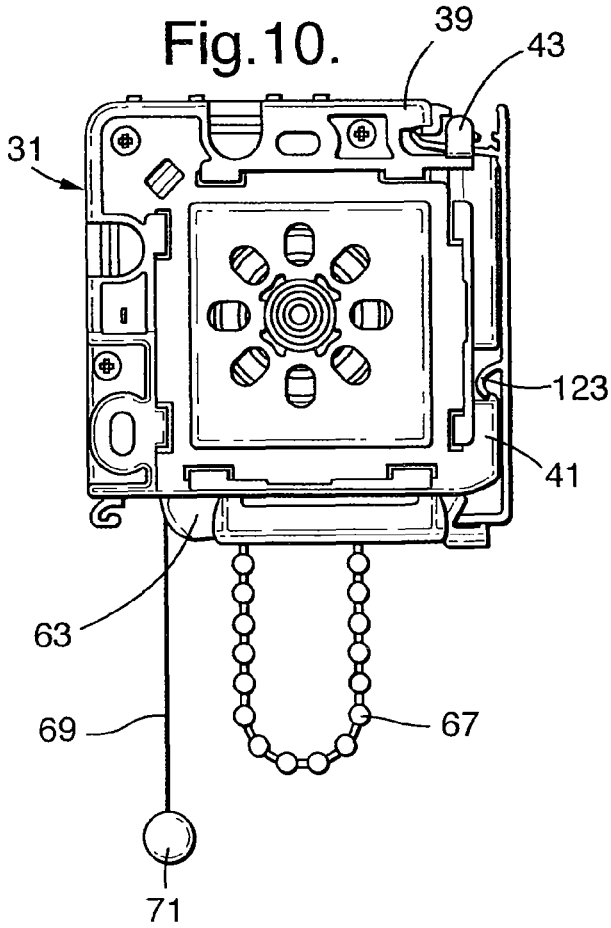
FIG. 10 is an elevation similar to FIG. 9, but with the bottom wall fully mounted onto the roller blind of FIG. 3.

As it is shown in FIG. 9 the wall element 81 with its first engagement ridge 121 is brought into engagement with the first wall engagement formations 9, 39 of the right hand and left hand end structures 1, 31. The first engagement ridge 121 also abuts the abutment 43. From this position the wall element 81 is moved into the direction of arrow 125, where upon the second engagement ridge 123 engages the second wall engagement formation 41 on the left hand end structure 31 and arrive at the position illustrated in FIG. 10. The cooperation with the right hand end structure 1 which is not visible in FIG. 9 and 10 is similar and takes place simultaneously.

Figure 11:
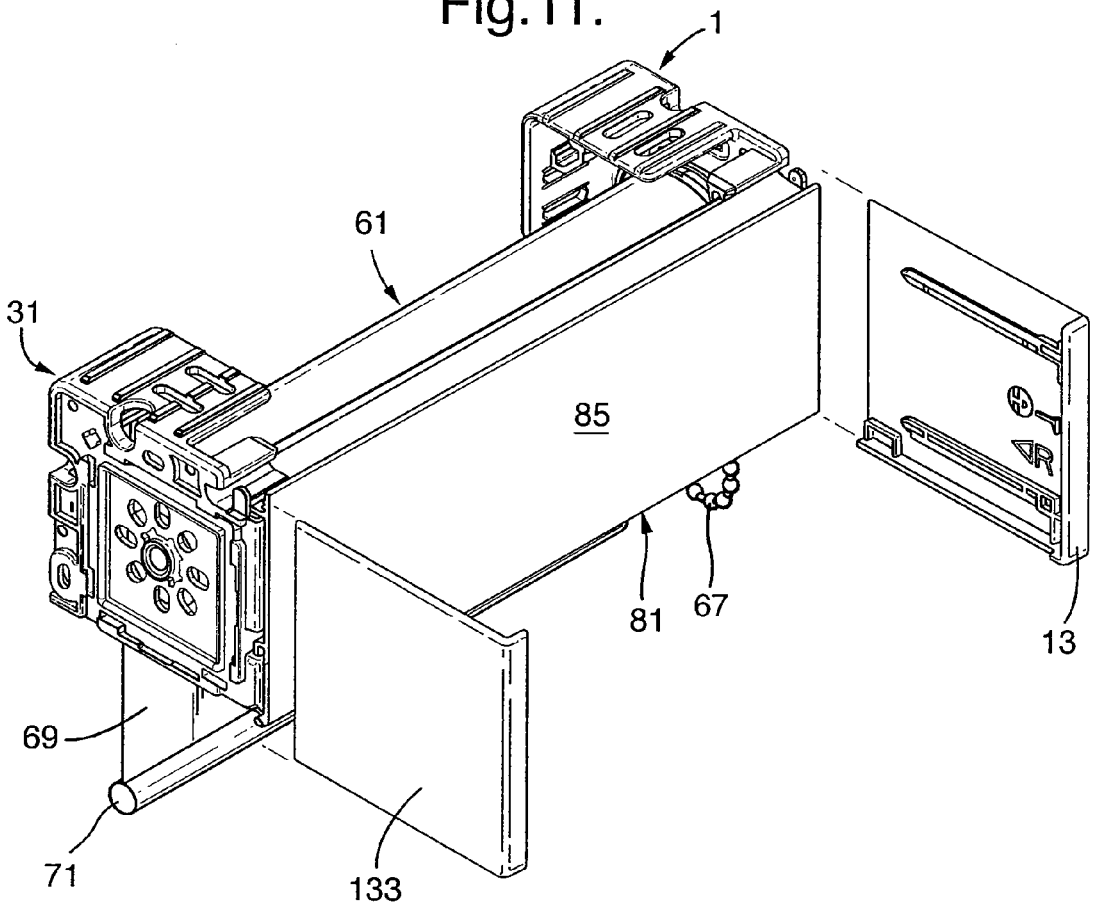
FIG. 11 is a perspective view of the roller blind of FIG. 10 with left and right hand end caps in position for being mounted onto the left hand and right hand end structures.

In case the right hand and left hand end structure 1, 31 remain in a visible position after mounting of the entire blind assembly to a rear or an overhead surface, right hand and left hand end caps 131, 133 can be slid onto the end structures a shown in FIG. 11. Such end caps are however optional.

Figure 12:
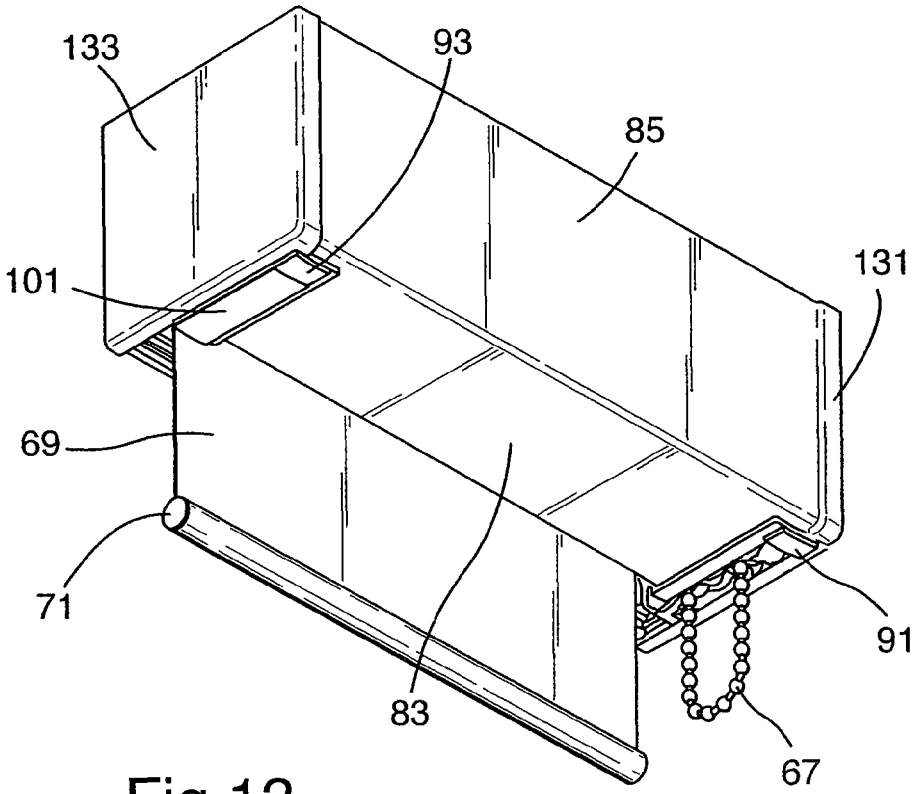
FIG. 12 is a perspective view from below showing the roller blind of FIG. 11 upon final assembly of its head rail with its bottom wall of FIG. 7 permitting an operating mechanism to be associated with a right hand end structure.
Figure 13:
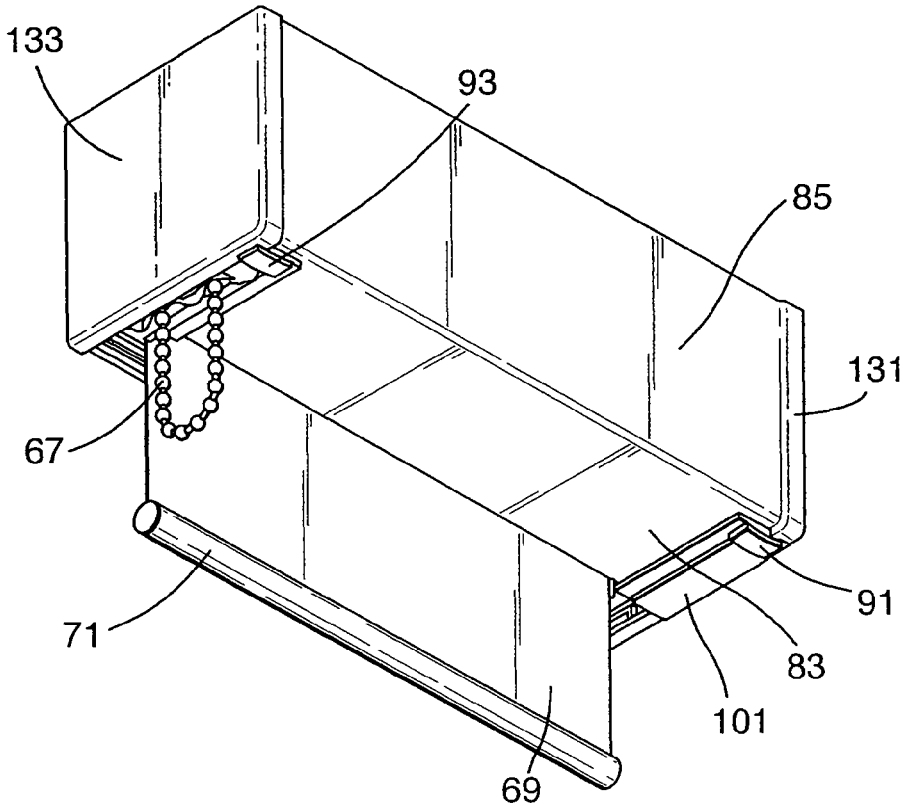
FIG. 13 is a perspective view similar to FIG. 12 but showing the roller blind of FIG. 11 upon final assembly of its head rail with its bottom wall of FIG. 7 permitting an operating mechanism to be associated with a left hand end structure.

FIG. 12 shows the blind of FIG. 11 after the end caps 131, 133 have been attached. An enclosed head rail structure is formed by the bottom wall 83 and the front wall 85 which completely hides the roller blind mechanism from view and also protects it against contamination or damage. The closure 101 closes the relevant right hand or left hand cut-out 87, 89 in the bottom wall 83 where there is no control mechanism and consequently no depending ball chain loop 67 that needs to exit from the head rail at the left side in FIG. 12. This arrangement provides for a symmetrical head rail which can also be used in case the operating ball chain loop 67 is required to be positioned at the left hand side of the head rail as shown in FIG. 13. In this case the closure 101 is attached to the right hand edge cover 91, when for some reason the closure 101 has been omitted, the flexibility of the bifurcated tongue 103 and the curved guiding surfaces 109, 111 (see FIGS. 4 to 7) will still allow retrofitting the closure 101 into a finished head rail. Similarly it would be possible when required to remove the closure 101 from an assembled heads rail.

Figure 14:
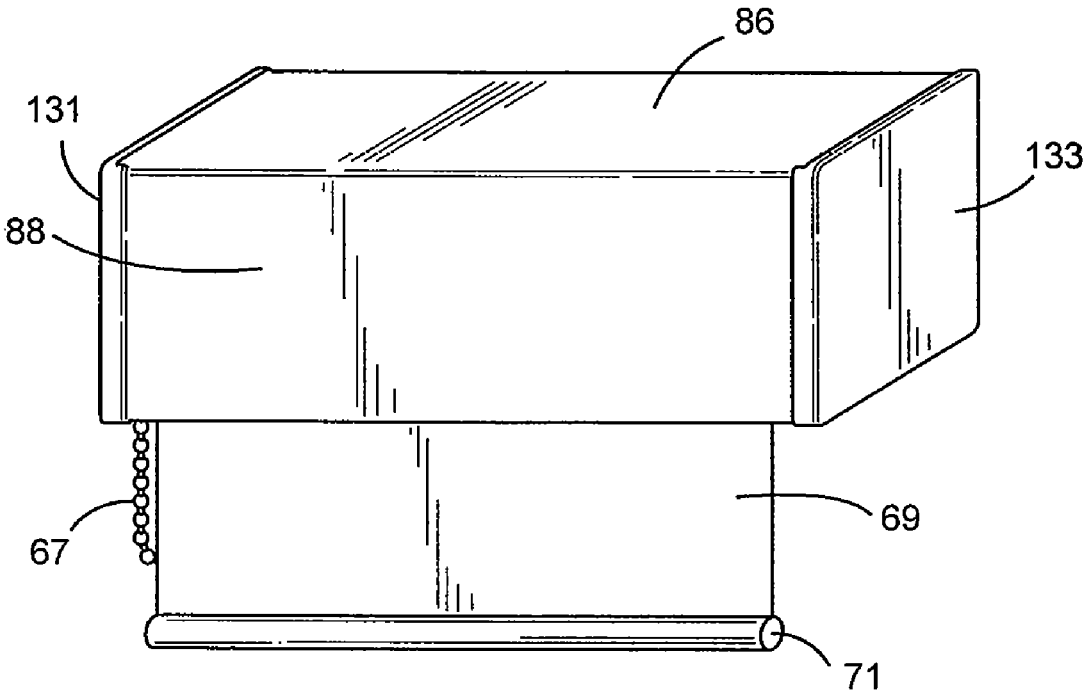
FIG. 14 is a rear perspective view of another embodiment of a roller blind.

Various modifications are in the purview of the present invention and will be easily accomplished by the skilled person. One such modification could be that the closure 101 is formed as an integral, but break-away portion of each edge cover 91, 93. In such a modified arrangement the closure is removed where it is not needed and left in place where it is needed. It is thus believed that the operation and construction of the present invention will be apparent from the foregoing description. While the described embodiment of head rail according to the invention has the strict minimum of a bottom wall and a front wall, variations having in addition a rear wall 88 and/or a top wall 86, as shown in FIG. 14, are possible without deviating from the scope of the invention. The right hand and left hand end structures, to this end, may be modified to provide additional engagement formations for receiving such rear and/or top walls. Where the blind is a roller blind the bottom wall is usually arranged to leave a longitudinal slot along its longitudinal rear edge to allow the blind fabric or screen material to extend from the head rail in proximity to the rear of the head rail. Occasionally it is preferred to have the blind or screen material to extend in proximity of the front wall of the head rail. In such cases the bottom wall can be formed as an integral part of a rear wall, or be separately attachable to the left hand and right hand end structures. Because the front wall of the head rail assembly can sometimes have an additional decorative function, it goes without saying that this does not strictly need to have a flat shape and can be curved or profiled according to requirement. The invention is not limited to any embodiment herein described and, within the purview of the skilled person; modifications are possible which should be considered within the scope of the appended claims. Equally all kinematic inversions are considered inherently disclosed and to be within the scope of the present invention. The term comprising when used in this description or the appended claims should not be construed in an exclusive or exhaustive sense but rather in an inclusive sense. Expressions such as: "means for . . . " should be read as:

"component configured for . . . " or "member constructed to . . . " and should be construed to include equivalents for the structures disclosed. The use of expressions like: "critical", "preferred", "especially preferred" etc. is not intended to limit the invention. Features which are not specifically or explicitly described or claimed may be additionally included in the structure according to the present invention without deviating from its scope.

The invention claimed is:

1. A head rail for an architectural covering, the head rail including:

an elongate front wall having left hand and right hand longitudinal ends, an elongate bottom wall having left hand and right hand longitudinal ends, a left hand end structure positioned adjacent to the left hand longitudinal end of the bottom wall;

a right hand end structure positioned adjacent to the right hand longitudinal end of the bottom wall, and an edge cover positioned between the left hand end structure and the left hand longitudinal end of the bottom wall, the edge cover defining a first surface oriented at an angle with respect to the bottom wall and defining a first slot;

wherein a second slot is defined in the bottom wall between the left hand end structure and the left hand longitudinal end of the bottom wall; and wherein a third slot is defined in the bottom wall between the right hand end structure and the right hand longitudinal end of the bottom wall, and wherein at least one of the second and third slots is closed by a removable closure.

2. The head rail of claim 1, wherein the removable closure is attached to the edge cover.

3. The head rail of claim 1, wherein the removable closure is a break-away element.

4. The head rail of claim 1, wherein the at least one removable closure has an attachment member for engagement with the edge cover.

5. The head rail of claim 4, wherein the attachment member is a male attachment member having a bifurcated end.

6. The head rail of claim 1, wherein the second and third slots are formed as a partial cut-out on the respective one of the left hand and right hand longitudinal ends of the bottom wall.

7. The head rail of claim 4, wherein the second and third slots of the left hand and right hand longitudinal ends of the bottom wall are each provided with an edge cover and wherein the attachment member is engageable with each of the edge covers.

8. The head rail of claim 1, further including a top wall.

9. The head rail of claim 1, further including a rear wall.

10. The head rail of claim 1, wherein the bottom wall and front wall are integrally formed.

11. The head rail of claim 1, wherein the first slot is further defined by an inside surface of the bottom wall.

12. The head rail of claim 1, wherein the first slot defines a funnel.

13. The head rail of claim 1, wherein the removable closure includes a flexible bifurcated tongue configured to engage the first slot.

14. A head rail for an architectural covering, the head rail including:

an elongate front wall having left hand and right hand longitudinal ends, an elongate bottom wall having left hand and right hand longitudinal ends, a left hand end structure positioned adjacent to the left hand longitudinal end of the bottom wall; and a right hand end structure positioned adjacent to the right hand longitudinal end of the bottom wall, wherein a first slot is defined between the left hand end structure and the left hand longitudinal end of the bottom wall;

wherein a second slot is defined between the right hand end structure and the right hand longitudinal end of the bottom wall;

wherein at least one of the first and second slots is closed by a removable closure;

wherein the removable closure has an attachment member for engagement with the bottom wall; and wherein the first and second slots of the left hand and right hand longitudinal ends of the bottom wall are each provided with an edge cover and wherein the attachment member is engageable with each of the edge covers, wherein each said edge cover includes a female attachment member to receive and hold the male attachment member of the removable closure.

* * * * *

UNITED STATES PATENT AND TRADEMARK OFFICE

CERTIFICATE OF CORRECTION

PATENT NO. : 7,900,680 B2
APPLICATION NO. : 12/200053
DATED : March 8, 2011
INVENTOR(S) : Garmyn et al.

It is certified that error appears in the above-identified patent and that said Letters Patent is hereby corrected as shown below:

Column 5, line 35, cancel claim 3.

Signed and Sealed this
Third Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,900,680 B2
APPLICATION NO. : 12/200053
DATED : March 8, 2011
INVENTOR(S) : Garmyn et al.

It is certified that error appears in the above-identified patent and that said Letters Patent is hereby corrected as shown below:

Delete the title page and substitute therefore the attached title page showing the corrected number of claims in patent.

Column 5, lines 35-36, cancel claim 3.

This certificate supersedes the Certificate of Correction issued May 3, 2011.

Signed and Sealed this
Thirty-first Day of May, 2011

David J. Kappos

David J. Kappos
*Director of the United States Patent and Trademark Office*

(12) United States Patent
Garmyn et al.

(10) Patent No.: US 7,900,680 B2
(45) Date of Patent: Mar. 8, 2011

(54) HEAD RAIL ASSEMBLY

(75) Inventors: Tomas M. A. H. Garmyn, Willebroek (BE); Jorg Bohlen, Langen (DE); Lars Koop, Bremerhaven (DE)

(73) Assignee: Hunter Douglas Industries B.V., El Rotterdam (NL)

( * ) Notice: Subject to any disclaimer, the term of this patent is extended or adjusted under 35 U.S.C. 154(b) by 245 days.

(21) Appl. No.: 12/200,053

(22) Filed: Aug. 28, 2008

(65) Prior Publication Data

US 2009/0056885 A1 Mar. 5, 2009

(30) Foreign Application Priority Data

Aug. 31, 2007 (EP) ..... 07017083

(51) Int. Cl.
*E06B 9/17* (2006.01)

(52) U.S. Cl. ..... 160/23.1; 160/321

(58) Field of Classification Search ..... 160/23.1, 160/24, 321, 38, 319, 193
See application file for complete search history.

(56) References Cited

U.S. PATENT DOCUMENTS

| | | | | |
|---|---|---|---|---|
| 2,099,068 | A * | 11/1937 | Keithly | 160/23.1 |
| 3,854,517 | A * | 12/1974 | Nakamura | 160/323.1 |
| 4,424,852 | A * | 1/1984 | Hopper | 160/309 |
| 4,492,261 | A * | 1/1985 | Chong | 160/319 |
| 4,757,852 | A * | 7/1988 | Jentof et al. | 160/23.1 |
| 5,092,389 | A | 3/1992 | Tedeschi | |
| 6,116,325 | A * | 9/2000 | Colson et al. | 160/321 |
| 6,148,894 | A * | 11/2000 | Judkins | 160/177 R |
| 6,935,401 | B2 * | 8/2005 | Fraczek et al. | 160/321 |
| 2006/0289120 | A1 * | 12/2006 | Pielmeier | 160/23.1 |
| 2009/0056885 | A1 * | 3/2009 | Garmyn et al. | 160/323.1 |

* cited by examiner

*Primary Examiner* — Blair M. Johnson
(74) *Attorney, Agent, or Firm* — Dorsey & Whitney LLP

(57) ABSTRACT

A head rail or head rail assembly for an architectural closure, the head rail including an elongate front wall having left hand and right hand longitudinal ends and an elongate bottom wall having left hand and right hand longitudinal ends. A left hand end structure is positioned adjacent to the left hand longitudinal end of the bottom wall and a right hand end structure is positioned adjacent to the right hand longitudinal end of the bottom wall. A first slot is defined between the left hand end structure and the left hand longitudinal end of the bottom wall and a second slot is defined between the right hand end structure and the right hand longitudinal end of the bottom wall. At least one of the first and second slots is closed by a removable closure.

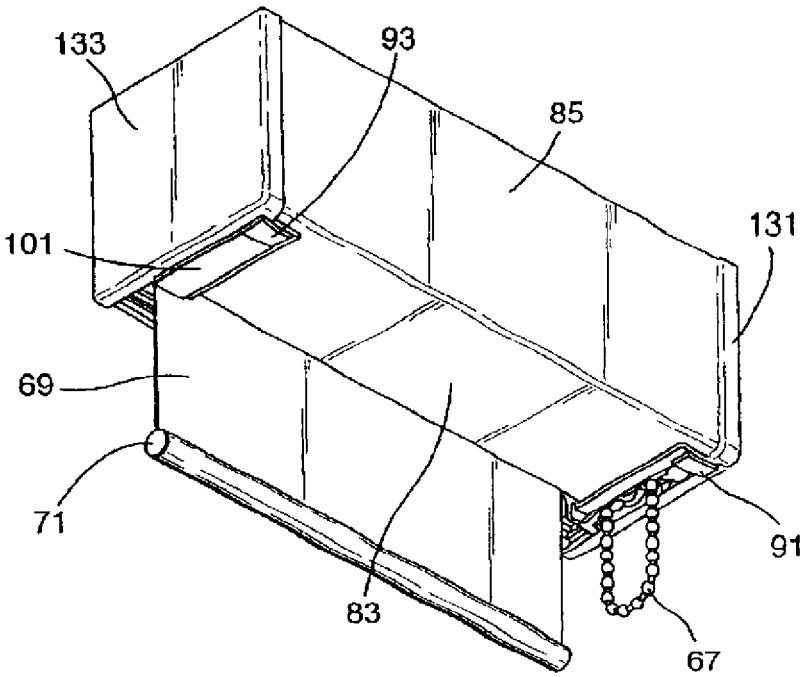

13 Claims, 9 Drawing Sheets